US007177392B2

(12) United States Patent
Shefer et al.

(10) Patent No.: US 7,177,392 B2
(45) Date of Patent: Feb. 13, 2007

(54) X-RAY DETECTOR FOR FEEDBACK STABILIZATION OF AN X-RAY TUBE

(75) Inventors: Ruth E. Shefer, Newton, MA (US); Robert E. Klinkowstein, Winchester, MA (US); Earl S. Marmar, Newton, MA (US)

(73) Assignee: Newton Scientific, Inc., Cambridge, MA (US)

( * ) Notice: Subject to any disclaimer, the term of this patent is extended or adjusted under 35 U.S.C. 154(b) by 0 days.

(21) Appl. No.: 10/659,065

(22) Filed: Sep. 10, 2003

(65) Prior Publication Data

US 2004/0109536 A1 Jun. 10, 2004

Related U.S. Application Data

(60) Provisional application No. 60/409,462, filed on Sep. 10, 2002.

(51) Int. Cl.
*H05G 1/44* (2006.01)

(52) U.S. Cl. ..... 378/108; 378/207

(58) Field of Classification Search ..... 378/97, 378/102, 122, 108–110, 98.7, 118, 207
See application file for complete search history.

(56) References Cited

U.S. PATENT DOCUMENTS

| | | | | |
|---|---|---|---|---|
| 3,567,854 | A | 3/1971 | Tschantz et al. | |
| 3,783,286 | A | 1/1974 | Kremer | |
| 4,051,377 | A | 9/1977 | Kemner et al. | |
| 4,172,223 | A * | 10/1979 | Ishijima et al. | 378/108 |
| 4,639,943 | A * | 1/1987 | Heinze et al. | 378/96 |
| 4,860,329 | A | 8/1989 | Weiser et al. | |
| 5,003,572 | A * | 3/1991 | Meccariello et al. | 378/98.7 |
| 6,178,226 | B1 * | 1/2001 | Hell et al. | 378/113 |
| 6,661,876 | B2 * | 12/2003 | Turner et al. | 378/138 |

* cited by examiner

*Primary Examiner*—Edward J. Glick
*Assistant Examiner*—Hoon Song
(74) *Attorney, Agent, or Firm*—Gauthier & Connors, LLP

(57) ABSTRACT

An x-ray tube emits X-rays in response to a current control signal. An X-ray detector detects the emitted X-rays and provides a detected X-ray signal indicative thereof to a control system, which provides the current control signal. The X-ray detector provides feedback stabilization of the X-ray output from a source of X-rays, such as, for example an X-ray tube. The detector produces an electrical signal proportional to the X-ray output of the X-ray tube, and that signal is used to control the electron beam current in the tube in order to stabilize the X-ray output of the tube at a predetermined value.

33 Claims, 7 Drawing Sheets

X-RAY DETECTOR FOR FEEDBACK STABILIZATION OF AN X-RAY TUBE

CROSS REFERENCE TO RELATED APPLICATIONS

This application claims priority from the provisional application designated serial No. 60/409,462 filed Sep. 10, 2002 entitled "X-ray Detector for Feedback Stabilization of an X-ray Tube", which is hereby incorporated by reference.

BACKGROUND OF THE INVENTION

The present invention relates to x-ray sources, and in particular to an X-ray source such as an X-ray tube that includes feedback stabilization, and more particularly X-ray feedback.

As shown in FIG. 1, conventional X-ray tubes employ feedback stabilization of the electron beam current in an attempt to realize stable tube operation. In that case, the anode current is input to a feedback loop to control the emission current from the filament or other electron emitter.

A problem with such a prior art system is that even in steady state it results in a fluctuating X-ray output. Therefore, there is a need for an X-ray source that operates in a closed loop manner to increase the steady state stability of the X-ray output.

SUMMARY OF THE INVENTION

Briefly, according to an aspect of the invention, an X-ray source comprises a X-ray tube that emits X-rays via an X-ray window in response to a current control signal. An X-ray detector senses X-rays emitted from the X-ray window and provides a detected X-ray signal indicative thereof to a control system, which provides the current control signal.

The X-ray detector provides feedback stabilization of the X-ray output of an X-ray tube. The detector produces an electrical signal proportional to the X-ray output of the X-ray tube, and that signal is used to control the electron beam current in the tube in order to stabilize the X-ray output of the tube at a predetermined value.

The X-ray detector may include for example, a silicon photodiode, a pin diode, an ionization detector, a scintillation detector, an electron multiplier (e.g., channeltron or photomultiplier), or a charge-coupled device (CCD) detector. The X-ray detector may be located anywhere relative to the X-ray tube, as long as the detector senses some of the X-ray flux from the tube. The X-ray detector may cover all, or a portion of, the X-ray window of the X-ray tube. This has the advantage of increasing the signal from the X-ray detector. If the detector covers a substantial portion of the X-ray window, then a detector transmissive to X-rays such as a thin silicon photodiode is preferred. If the detector covers the entire X-ray output window of the tube, then it may be used to also provide attenuation and filtering of the X-ray spectrum.

The detector may be placed at a location outside the tube so that the X-ray output of the tube can be sampled without interfering with operation of the tube. In those embodiments, a detector with high X-ray sensitivity is preferred, such as an electron multiplier-type detector. The invention may be used with X-ray tubes operating at any current or voltage level.

The technique of the invention may be particularly desirable in low current X-ray tubes. In such low current X-ray tubes (e.g., operating with less than about 100 μA electron emission current) leakage current becomes a factor.

These and other objects, features and advantages of the present invention will become apparent in light of the following detailed description of preferred embodiments thereof, as illustrated in the accompanying drawings.

DETAILED DESCRIPTION OF THE INVENTION

Figure 1:
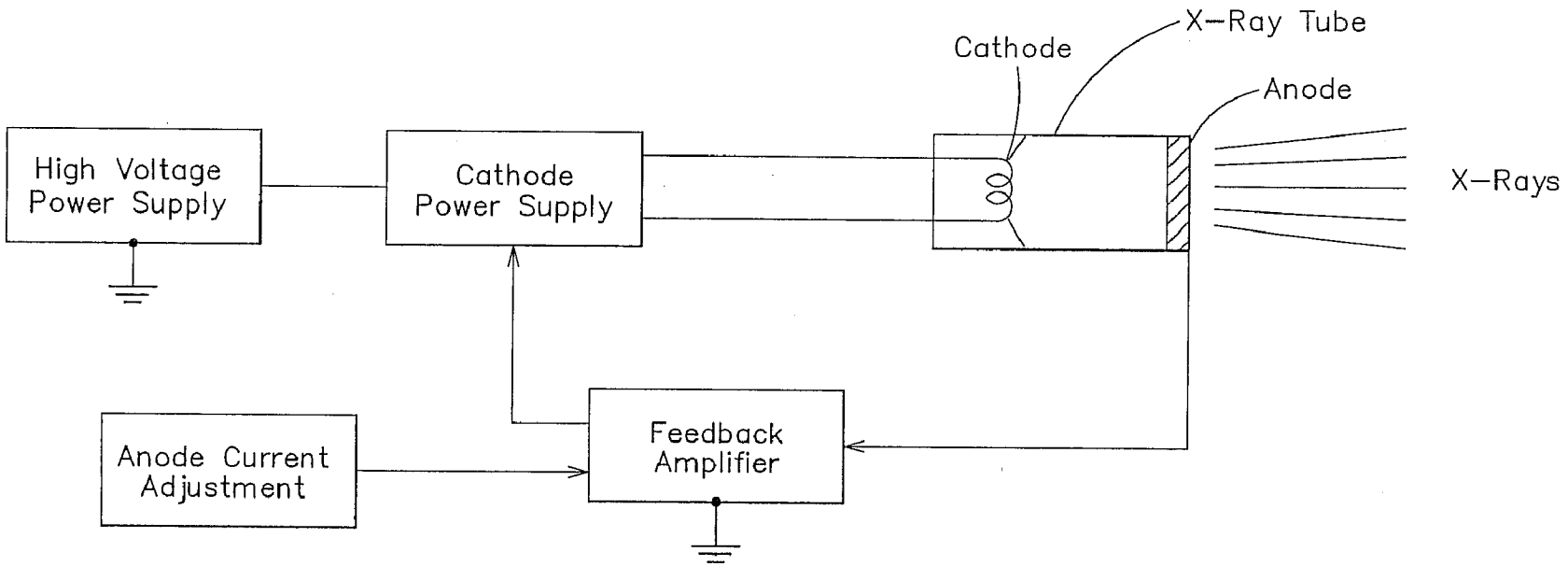
FIG. 1 (Prior Art)
FIG. 1 illustrates a prior art x-ray source with a conventional feedback system using anode current.
Figure 2:
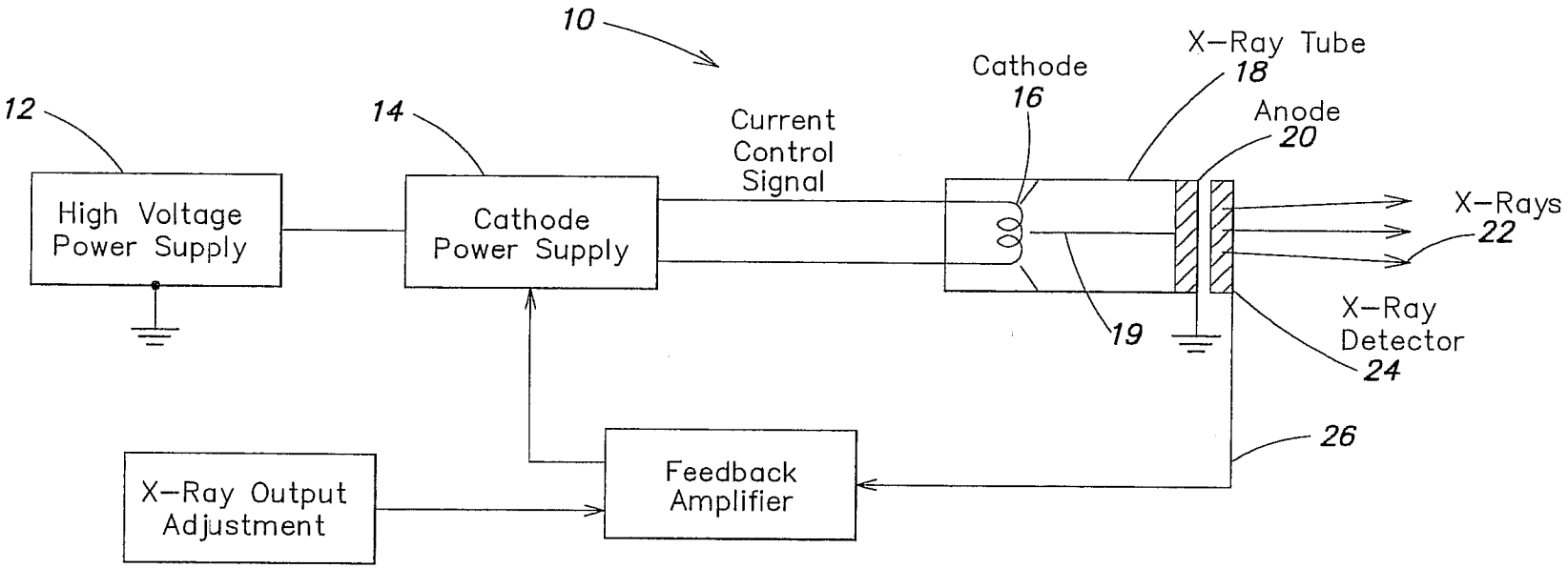
FIG. 2 illustrates an x-ray source that employs an X-ray detector for feedback stabilization of an X-ray tube.

FIG. 2 illustrates an x-ray source 10 that includes a high voltage power supply 12 and a cathode power supply 14 that drive a cathode 16 of an x-ray tube 18. As known, the cathode 16 emits a beam of electrons 19 that strike an anode 20 of the x-ray tube 18 to generate x-rays 22.

The source 10 includes an X-ray detector 24 positioned to intercept at least a portion of the X-ray output of the tube and provide a signal on a line 26 that is input to an emission current feedback circuit. The emission current is controlled to provide the desired (e.g., constant) X-ray output from the tube. The inventive control technique provides superior X-ray output stability compared with conventional feedback-stabilized X-ray tubes in which emission current is controlled to provide constant anode current. The invention mitigates the effects of time varying leakage currents, which contribute to the anode current signal but may not contribute to the useful X-ray output of the tube. The effects of leakage currents are particularly important in tubes operating at relatively low emission currents, for example in the microampere current range. In the case in which different X-ray tubes of the same type have different X-ray output levels per unit beam current, the technique of the present invention provides the capability to set the X-ray output level of different tubes at a predetermined value.

Figure 3:
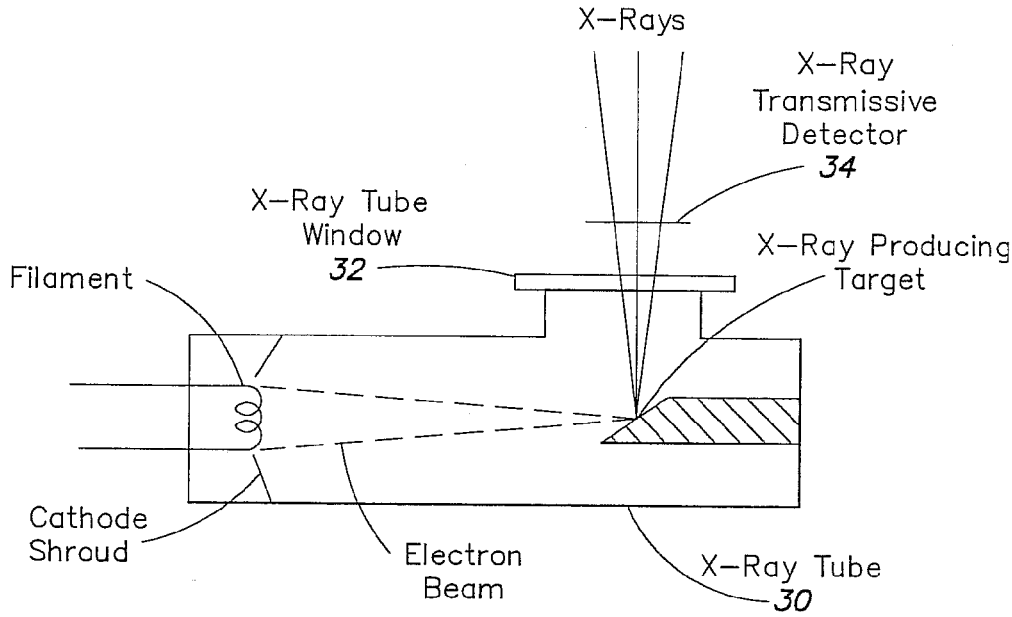
FIG. 3 is a pictorial illustration of an X-ray tube that provides X-rays, which pass through an X-ray window and a X-ray transmissive detector.

FIG. 3 is a pictorial illustration of an X-ray tube 30 that provides X-rays, which pass through an X-ray tube window 32 and a X-ray transmissive detector 34. In one embodiment, the x-ray detector 34 is configured as a silicon photodiode detector that is mounted directly over the X-ray output window 32 so the X-ray beam produced by the tube passes through the photodiode. The photodiode may cover all or part of the X-ray output window 32. If the photodiode covers the entire X-ray window, the photodiode may also serve as an X-ray attenuator and/or filter. A typical photodiode includes silicon and is about 0.015–0.025 inches thick. The photodiode may attenuate the low energy portion of the X-ray spectrum from the X-ray tube, in the same way that an Aluminum (Al) filter is commonly used for this purpose. If additional filtering of the X-ray spectrum is desired, an additional thickness of Al or another material may be placed over the X-ray window of the tube. In order to enhance the output signal from the photodiode in response to the X-ray flux, the additional thickness of filter material is preferably placed on the side of the X-ray diode away from the X-ray window 32. Alternatively, the filter material may be placed between the X-ray window and the photodiode, so the photodiode is exposed to filtered X-rays. This embodiment is particularly useful where it is desirable to stabilize the filtered output. The electrical output current generated by the photodiode in response to the X-ray flux is input to a feedback circuit (FIG. 2) that controls the electron current emitted by the cathode of the X-ray tube. Feedback circuits are well known in the art.

Figure 4:
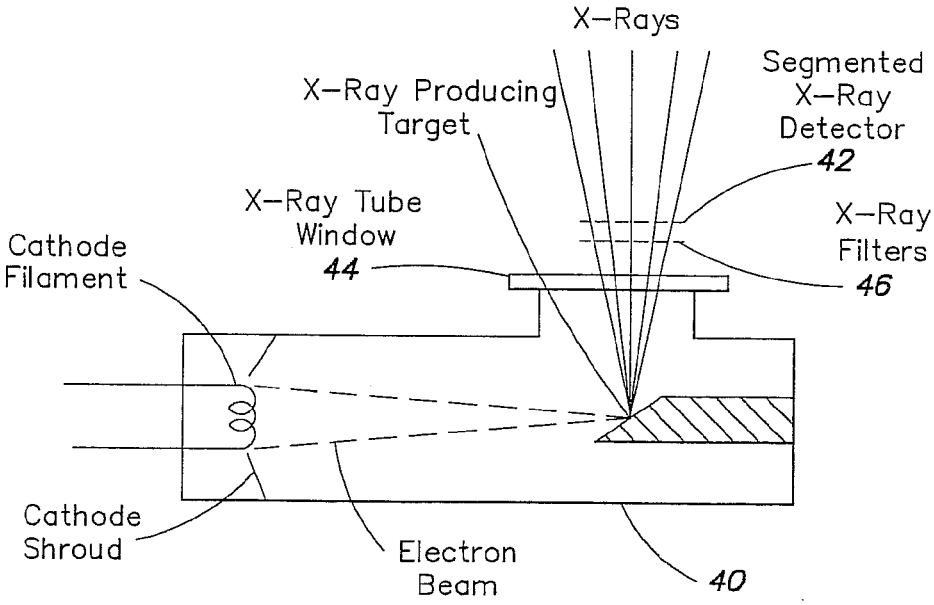
FIG. 4 is a pictorial illustration of an alternative embodiment X-ray source.

FIG. 4 is a pictorial illustration of an alternative embodiment X-ray source. In this embodiment a photodiode array 42 having two or more detector elements is mounted directly over X-ray output window 44 of X-ray tube 40 as described above. Filter elements 46 are mounted between one or more of the elements of the photodiode array 42 and the X-ray output window 44 so that the X-ray flux incident on different elements of the array 42 is altered by the presence of the filter elements 46. The filter elements 46 may attenuate some portion of the X-ray spectrum from the tube, or the filter element may contain a material that produces characteristic radiation when illuminated by the X-ray spectrum from the tube. Thus signals from the array elements 42 may be used to monitor different characteristics of the X-ray spectrum. For example, an unfiltered element may be used in conjunction with an element filtered by 0.01–0.03 inches of Aluminum to separately monitor the total output and the high energy output of a 25–50 kV X-ray tube. As another example, an unfiltered element may be used in conjunction with an element filtered by a material having a K-edge just above the K-alpha lines of silver to monitor both the total output and the K-line output of a X-ray tube having a silver anode. In this embodiment, the electrical current generated by the filtered or unfiltered elements may be input directly into the feedback circuit as in the first embodiment. Alternately, a specific combination of filtered and unfiltered signals, such as their ratio, difference, or sum may be used in the feedback loop to optimize a particular characteristic of the X-ray output of the tube.

Figure 5:
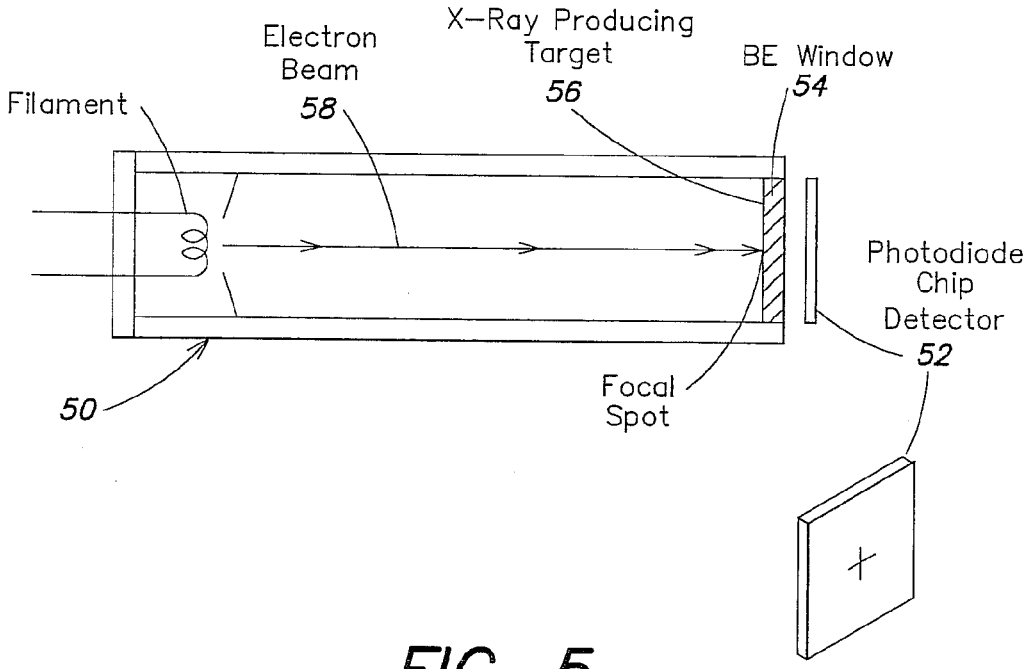
FIG. 5 illustrates yet another alternative embodiment X-ray source.

FIG. 5 illustrates yet another alternative embodiment X-ray source. In this embodiment a photodiode detector 52 is mounted directly over an X-ray output window 54 of an X-ray tube 50 that includes a transmissive anode 56. An advantage of this embodiment is that the photodiode 52 can be placed in relatively close proximity to the source of X-rays (the focal spot), thereby increasing the photodiode signal. This configuration also insures that the photodiode 52 will be most sensitive to X-rays from the focal spot compared with X-rays produced elsewhere in the tube, such as for example X-rays produced by leakage currents incident on other surfaces in the tube. The output signal from the photodiode detector 52 is input to a feedback circuit that controls the electron current 58 in the tube to stabilize the X-ray output of the tube at a predetermined value.

Photodiodes of the type described above are available from several manufacturers, including United Detector Technology Inc. (Culver City, Calif.), Photonic Detectors Inc. (Simi Valley, Calif.), and International Radiation Detectors Inc. (Torrance, Calif.). An example of a suitable silicon photodiode detector is the Model PDB-C609 bare photoconductive photodiode detector made by Photonic Detectors Inc.

Figure 6:
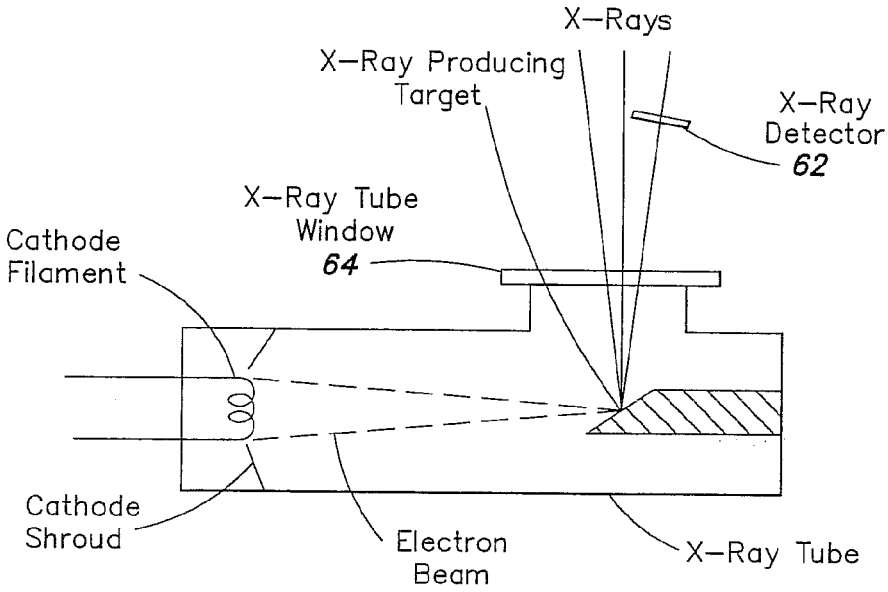
FIG. 6 illustrates still yet another alternative embodiment X-ray source.

FIG. 6 illustrates yet another alternative embodiment X-ray source. In this embodiment an X-ray detector 62 is mounted at a location in the vicinity of an X-ray output window 64, but does not cover any portion of the output window. The X-ray detector 62 (e.g., a photodiode) is preferably located at a position that samples a representative portion of the X-ray flux of the tube, but does not significantly interfere with the intended use of the tube. The photodiode detector provides an output signal to a feedback circuit that controls the electron current in the tube in order to stabilize the X-ray output of the tube. Any X-ray detector with sufficient sensitivity to provide a useable feedback signal may be used.

Figure 7:
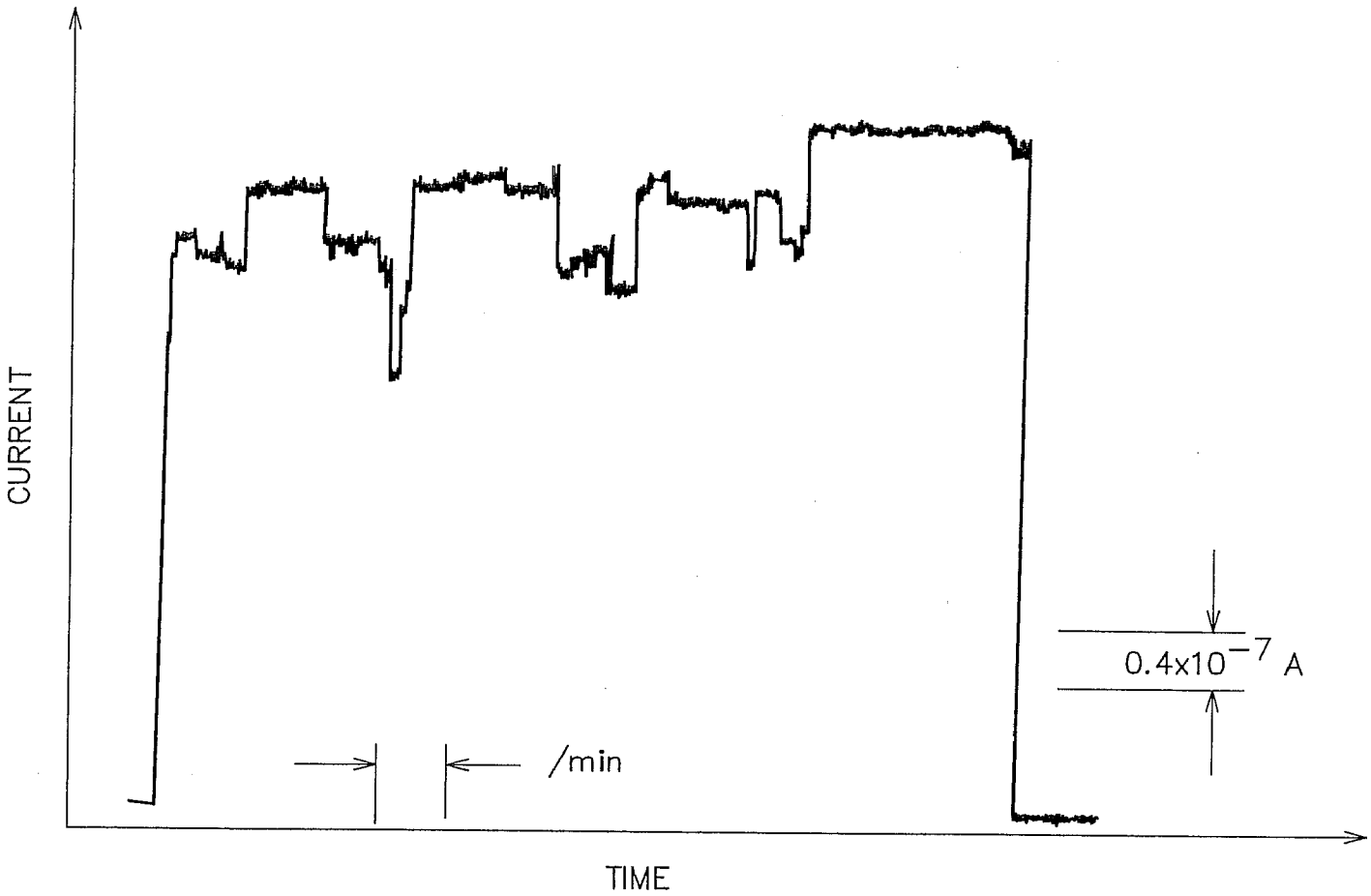
FIG. 7 is a plot of X-ray photodiode output current versus time when the X-ray source was operated in conventional feedback mode.
Figure 8:
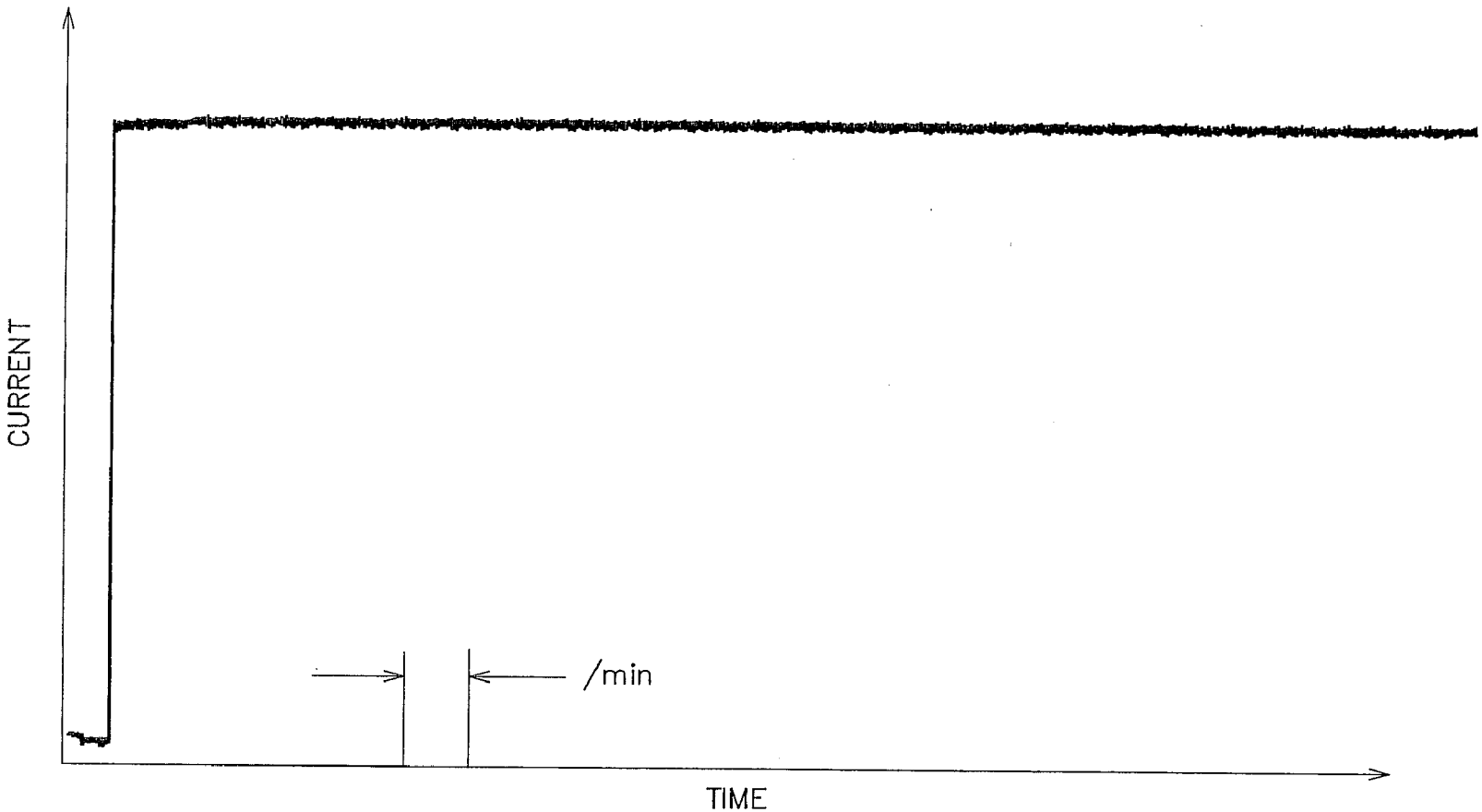
FIG. 8 is a plot of X-ray photodiode output current versus time from the same X-ray tube as used for the test illustrated in FIG. 7, when the photodiode signal is input to a current feedback loop.

To demonstrate the advantages of X-ray detector feedback stabilization of the output of an X-ray tube, a system of the type shown in FIG. 5 was assembled and tested. A Model PDB-C609 bare photodiode (Photonic Detectors Inc.) was sealed in a thin light-tight package and mounted directly over the output window of a transmission anode X-ray tube (Newton Scientific Model No. NS52-075). The dimensions of the tube were 0.8 cm in diameter and 3.5 cm in length. The X-ray tube transmission anode comprised a 1.5 micron thick Ag layer, 4 mm in diameter, deposited on a 0.5 mm thick Be disk. The distance between the silicon photodiode element and the outside surface of the X-ray window was approximately 1.3 mm. The X-ray tube was operated at 35 kV. Under these conditions, the magnitude of the photodiode current was measured to be approximately 15% of the anode current. The X-ray tube was powered by a Newton Scientific high voltage power supply (Model NS52-044) with an Inpho low voltage control board. FIG. 7 is a plot of X-ray photodiode output current versus time when the power supply was operated in conventional feedback mode, that is, with the anode current signal input to the cathode (filament) feedback loop. In that mode of operation, the photodiode signal varied by approximately ±11% about the mean value, indicating a corresponding variation in the X-ray output of the tube. This variation is likely caused by time-varying sources of leakage current in the X-ray tube that produce little X-ray flux compared with the primary electron beam. Other error sources may include: (i) movement of the focal spot on the anode; (ii) variations in the anode thickness; (iii) change of diameter of the focal spot on the anode; and (iv) changes of voltage. FIG. 8 is a plot of X-ray photodiode output current versus time from the same X-ray tube when the photodiode signal is input to the current feedback loop. In this case, the measured curve is obtained using an independent X-ray detector. It is clearly evident from FIG. 8 that the use of the inventive photodiode stabilization technique and apparatus results in an X-ray output that is constant to within better than ±1%.

Figure 9:
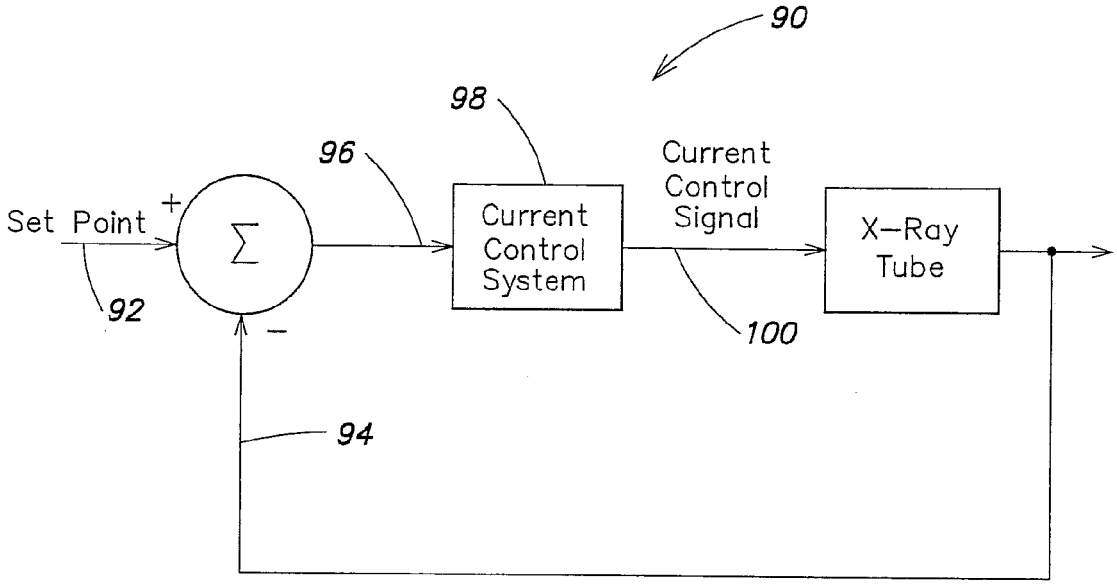
FIG. 9 is a block diagram illustration of a control loop.

FIG. 9 is a block diagram illustration of a control system 90. The system receives a reference signal value on a line 92 and computes the difference between the reference signal on the line 92 and the feedback signal from the X-ray detector on line 94. The difference is provided on a line 96 to a compensator 98, which provides a current control signal on a line 100. The compensator may include control logic such as proportional, integral and/or derivative control. The specific compensator employed will be a system design consideration based upon the operational requirements of the x-ray source that it controls. It is contemplated that the control system may also include for example an inner loop on anode current. In addition, it is further contemplated that a feedforward control technique may also be employed to control the x-ray source using an X-ray detector. The reference signal on the line 92 may be a controlled time varying signal, such that the X-ray flux from the tube is also time varying.

Although a silicon photodiode is a preferred detector, it is contemplated that photodiodes of other semiconductive materials may be used.

The x-ray feedback technique of the present invention may be used to stabilize the X-ray output of an X-ray fluorescence (XRF) spectrometer or other analytical device in which temporal stability and unit-to-unit constancy of the X-ray output intensity and spectrum are very important. When a photodiode detector is used, the invention is particularly suitable for use in a battery-operated instrument, such as a hand-held X-ray fluorescence (XRF) instrument, because the photodiode uses negligible electrical power.

One of ordinary skill will recognize that the stabilization technique of the present invention is of course not limited to X-ray tubes. Other X-ray sources, especially those operating at low current levels will find it desirable to utilize an X-ray detector in the X-ray source control. In addition, although the present invention has been discussed in the context of X-rays one of ordinary skill in the art will recognize that the technique may be also be employed with sources operating in other regions of the electromagnetic spectrum, such as for example Gamma ray sources, ultraviolet (UV) sources, or visible light sources.

Although the present invention has been shown and described with respect to several preferred embodiments thereof, various changes, omissions and additions to the form and detail thereof, may be made therein, without departing from the spirit and scope of the invention.

What is claimed is:

1. A system for controlling the X-ray output of an X-ray tube, said system comprising:

an X-ray tube that emits an X-ray output in response to a control signal;

an X-ray transmissive X-ray detector through which at least a portion of said X-ray output passes that detects X-rays emitted from said X-ray tube, and provides a detected X-ray signal indicative of a property of the X-rays that are emitted by the X-ray tube; and a control system that receives said detected X-ray signal and provides said control signal responsive to changes in conditions within said X-ray tube to ensure that said X-ray output is substantially maintained at a predetermined value.

2. The system as claimed in claim 1, wherein said changes in conditions within the X-ray tube include changes in leakage currents within the X-ray tube.

3. The system as claimed in claim 1, wherein said changes in conditions within the X-ray tube include changes any of the size, shape or location of a focal spot of electrons on an anode within the X-ray tube.

4. The system as claimed in claim 1, wherein said detected X-ray signal is maintained at a substantially constant value by said control system.

5. The system as claimed in claim 1, wherein said property of the X-rays that are emitted by the X-ray tube is the intensity of the X-rays that are emitted from the X-ray tube.

6. The system as claimed in claim 1, wherein said X-ray tube comprises an X-ray window through which the X-rays pass, and said X-ray detector is positioned adjacent to said X-ray window.

7. The system as claimed in claim 6, wherein said X-ray detector partially covers said X-ray window.

8. The system as claimed in claim 6, wherein said X-ray detector completely covers said X-ray window.

9. The system as claimed in claim 6, wherein substantially all of said X-ray output that passes through the X-ray window inpinges on the X-ray transmissive X-ray detector.

10. The system as claimed in claim 6, wherein said system further includes an X-ray anode that is positioned near the X-ray window.

11. The system as claimed in claim 6, wherein said X-ray window comprises an X-ray transmissive anode.

12. The system as claimed in claim 6, wherein said system further includes a filter and wherein substantially all of said X-ray output that passes through the X-ray window impinges on the filter.

13. The system as claimed in claim 1, wherein said X-ray detector provides a filter function.

14. The system as claimed in claim 1, wherein said X-ray detector is configured and arranged as a segmented detector that includes a plurality of detector elements.

15. The system as claimed in claim 14, wherein at least one of said detector elements includes a filter.

16. The system as claimed in claim 14, wherein said property of the X-rays is provided by a ration of detected X-ray signals from at least two of said detector elements.

17. The system as claimed in claim 1, wherein said X-ray tube includes an X-ray producing target and said X-ray detector is positioned substantially close to said X-ray producing target.

18. The system as claimed in claim 1, wherein said control signal is a current control signal.

19. The system as claimed in claim 18, wherein said current control signal controls the temperature of a cathode in the X-ray tube.

20. The system as claimed in claim 1, wherein said X-ray detector comprises at least one of a photodiode, a pin diode, an ionization detector, a scintillation detector, an electron multiplier, and a charge-coupled device.

21. The system as claimed in claim 1, wherein said system is included within a battery powered device.

22. The system as claimed in claim 1, wherein said system is included in a hand-held device.

23. The system as claimed in claim 1, wherein said system is configured for use as an X-ray fluorescence analytical instrument.

24. A system for controlling the X-ray output of an X-ray tube, said system comprising:

an X-ray tube that emits an X-ray output through a window in response to a control signal;

an X-ray detector that is on said window and on which at least some of the X-ray output impinges, said X-ray detector providing a detected X-ray signal indicative of a property of the X-rays that are emitted by the X-ray tube through the window; and a control system that receives said detected X-ray signal and adjusts said control signal responsive to changes in conditions within said X-ray tube to ensure that said X-ray output is substantially maintained at a predetermined value.

25. The system as claimed in claim 24, wherein said changes in conditions within the X-ray tube include changes in leakage currents within the X-ray tube.

26. The system as claimed in claim 24, wherein said changes in conditions within the X-ray tube include changes in any of the size, shape or location of electrons on an anode within the X-ray tube.

27. The method of controlling the X-ray output of an X-ray tube, said method comprising the steps of:

providing an X-ray tube that emits an X-ray output in response to a control signal;

providing an X-ray transmissive X-ray detector through which at least a portion of said X-ray output passes that detects X-ray emitted from said X-ray tube, providing a detected X-ray signal indicative of a property of the X-rays that are emitted by the X-ray tube; and adjusting said control signal reponsive to changes in conditions within the X-ray tube to ensure that said detected X-ray signal is substantially maintained at a predetermined value.

28. The method as claimed in claim 27, wherein said X-ray tube includes an X-ray output window and said X-ray detector is positioned substantially close to said X-ray window.

29. The method as claimed in claim 27, wherein substantially all of said X-ray output from the window impinges on said X-ray detector.

30. The method as claimed in claim 27, wherein said X-ray tube includes an X-ray producing target and said X-ray detector is positioned substantially close to said X-ray producing target.

31. The method of controlling the X-ray output of an X-ray tube, said method comprising the steps of:

providing an X-ray tube that emits an X-ray ouput through a window in response to a control signal;

providing an X-ray detector that on the window and on which at least a portion of said X-ray output impinges, providing a detected X-ray signal indicative of a property of the X-ray that are emitted by the X-ray tube; and adjusting said control signal responsive to changes in conditions within the X-ray tube to insure that said detected X-ray signal is substantially maintained at a predetermined value.

32. The method as claimed in claim 31, wherein said X-ray detector is transmissive.

33. The method as claimed in claim 31, wherein said X-ray tube includes an X-ray producing target and said X-ray detector is positioned substatially close to said X-ray producing target.

* * * * *

UNITED STATES PATENT AND TRADEMARK OFFICE

CERTIFICATE OF CORRECTION

PATENT NO. : 7,177,392 B2
APPLICATION NO. : 10/659065
DATED : February 13, 2007
INVENTOR(S) : Ruth E. Shefer et al.

It is certified that error appears in the above-identified patent and that said Letters Patent is hereby corrected as shown below:

In claim 1, Col. 5, line 45, please delete "provides" and replace with --adjusts--.

In claim 9, Col. 6, line 11, please delete "inpinges" and replace with --impinges--.

In claim 16, Col. 6, line 29, please delete "ration" and replace with --ratio--.

In claim 27, Col. 7, line 5, please delete "The method" and replace with --A method--.

In claim 27, Col. 7, line 11, please delete "X-ray emitted" and replace with --X-rays emitted--.

In claim 27, Col. 7, line 14, please delete "reponsive" and replace with --responsive--.

In claim 31, Col. 8, line 1, please delete "The method" and replace with --A method--.

In claim 31, Col. 8, line 7, please delete "ouput" and replace with --output--.

In claim 31, Col. 8, line 12, please delete "X-ray that" and replace with --X-rays that--.

In claim 31, Col. 8, line 14, please delete "insure" and replace with --ensure--.

In claim 33, Col. 8, line 21, please delete "substatially" and replace with --substantially--.

Signed and Sealed this

Seventeenth Day of July, 2007

JON W. DUDAS
*Director of the United States Patent and Trademark Office*